US012753771B2

(12) United States Patent
Jimenez

(10) Patent No.: US 12,753,771 B2
(45) Date of Patent: Oct. 6, 2026

(54) MULTISTAGE DISC PUMP FOR MULTIPHASE FLUIDS

(71) Applicant: MXQ, LLC, Houston, TX (US)

(72) Inventor: Juan Jimenez, Houston, TX (US)

( * ) Notice: Subject to any disclaimer, the term of this patent is extended or adjusted under 35 U.S.C. 154(b) by 0 days.

(21) Appl. No.: 18/987,585

(22) Filed: Dec. 19, 2024

(65) Prior Publication Data

US 2026/0177067 A1 Jun. 25, 2026

(51) Int. Cl.
*F04D 1/06* (2006.01)
*F04D 7/02* (2006.01)
*F04D 29/24* (2006.01)

(52) U.S. Cl.
CPC ..... *F04D 29/24* (2013.01); *F04D 1/06* (2013.01); *F04D 7/02* (2013.01)

(58) Field of Classification Search
CPC . F04D 5/001; F04D 1/025; F04D 7/02; F04D 29/2216; F04D 29/2238; F04D 29/2261; F04D 29/2272; F04D 29/242; F04D 29/448; F04D 1/06; F04D 31/00; F04D 29/24; F04D 29/245
See application file for complete search history.

(56) References Cited

U.S. PATENT DOCUMENTS 1,013,248 A 1/1912 Wilkinson
1,061,206 A 5/1913 Tesla
1,329,559 A 2/1920 Tesla
4,773,819 A 9/1988 Gurth
4,940,385 A * 7/1990 Gurth ..... F04D 5/001 415/206
5,355,993 A 10/1994 Hay
5,385,443 A 1/1995 Dufour
5,551,553 A 9/1996 Hay
6,752,597 B2 * 6/2004 Pacello ..... F04D 29/2255 416/198 R
7,044,288 B2 5/2006 Baer et al.
7,553,124 B1 6/2009 Jimenez
(Continued)

FOREIGN PATENT DOCUMENTS

CN 118208419 A * 6/2024
EP 3904695 A1 * 11/2021 ..... F04D 13/10
(Continued)

OTHER PUBLICATIONS

English machine translation of KR-10-1407869-B1, Dec. 10, 2025.*
(Continued)

*Primary Examiner* — Nathaniel E Wiehe
(74) *Attorney, Agent, or Firm* — Egbert, McDaniel & Swartz, PLLC

(57) ABSTRACT

A disc pump for multiphase fluids has a bowl with an interior volume and a disc set rotatably mounted in the interior volume of the bowl. The bowl has an inlet and outlet. The inlet is adapted to receive the multiphase fluid therein. The outlet is adapted to pass a pumped multiphase fluid outwardly from the bowl. The disc set has a drive disc and a driven disc. At least one of the drive disc and the driven disc has a plurality of micro vanes formed thereon or affixed thereto. The plurality of micro vanes extend toward another of the drive disc in the driven disc. The plurality of micro vanes are adapted to interact with the multiphase fluid passing through the bowl.

14 Claims, 7 Drawing Sheets

(56) References Cited

U.S. PATENT DOCUMENTS

| | | | |
|---|---|---|---|
| 8,210,816 | B2 | 7/2012 | Geldenhuys |
| 11,680,578 | B1 | 6/2023 | Jimenez |
| 2007/0258824 | A1 | 11/2007 | Pacello et al. |
| 2008/0213093 | A1 | 9/2008 | Guelich |
| 2012/0014779 | A1 | 1/2012 | Gilliam |
| 2015/0308446 | A1 | 10/2015 | Koivikko et al. |
| 2015/0328603 | A1 | 11/2015 | Smith et al. |
| 2016/0215798 | A1 | 7/2016 | Gilliam et al. |

FOREIGN PATENT DOCUMENTS

| | | | | |
|---|---|---|---|---|
| JP | 2013-194558 | A | * | 9/2013 |
| KR | 10-2012-011752 | A | * | 10/2012 |
| KR | 10-1407869 | B1 | * | 6/2014 |
| WO | 2014073976 | A1 | | 5/2014 |

OTHER PUBLICATIONS

English machine translation of JP-2013-194558-A, Dec. 10, 2025.*
English machine translation of CN-118208419-A, Dec. 10, 2025.*
English machine translation of KR-10-2012-011752-A, Dec. 10, 2025.*

* cited by examiner

MULTISTAGE DISC PUMP FOR MULTIPHASE FLUIDS

CROSS-REFERENCE TO RELATED APPLICATIONS

Not applicable.

FIELD OF THE INVENTION

The present invention relates to disc pumps. More particularly, the present invention relates to multistage disc pumps for moving multiphase fluids.

BACKGROUND OF THE INVENTION

Boundary layer or bladeless turbines, pumps, and other related turbo-machinery have been known for one hundred years or more. Nikola Tesla obtained a patent (U.S. Pat. No. 1,061,142) for such a device in 1913. The Tesla patent disclosed a multiple-disc pump that utilized rotating flat discs with no blades, vanes, or propellers. Such pumps have been referred to as disc pumps, boundary layer pumps, or bladeless pumps.

In U.S. Pat. No. 1,061,206, Tesla disclosed a fluid-driven boundary layer or bladeless turbine which may be utilized as a prime mover in various applications. The Tesla bladeless turbine, when used as the driving force for a hydro-electric generator, could transform the kinetic energy of a flowing fluid into electrical energy. In U.S. Pat. No. 1,329,559, Tesla disclosed another application of the bladeless turbine, this time in an internal combustion engine. The Tesla patent showed early disclosures of rotational machines using bladeless or boundary layer discs.

Unlike more traditional centrifugal pumps which utilize vanes, blades, augers, buckets, pistons, gears, diaphragms, and the like, boundary layer pumps, such as those described by Tesla, typically utilize multiple rotating parallel discs. Disc pumps, as these machines are sometimes called, utilize the fluid properties of adhesion and viscosity. These fluid properties combine to create an interaction between the fluid and the rotating flat discs that allow the transfer of mechanical energy from the rotating discs to the fluid.

Boundary layer or disc pumps (both names are used in the industry and both are used interchangeably) have been reported to have advantages over traditional pumps, especially when utilized for pumping fluids other than cool, clean, homogenous liquids. The vanes, buckets, or the like, of traditional pumps wear and lose effectiveness due to normal friction and/or impingement with particles (such as sand or other abrasives). However, the flat surfaces of boundary layer pumps are much less susceptible to wear. It is not unusual for such a pump to show little or no wear even after extended use.

Disc pumps have been found to be especially effective for pumping high viscosity fluids wherein an efficiency of such pumps may actually increase as the fluid viscosity increases. Disc pumps have also been reported to be more cost-effective in terms of reliability and decreased downtime for pumping problematic multiphase fluids, which may comprise gases, liquids, and/or solid materials. Disc pumps have been found to greatly reduce maintenance costs and downtime when used to replace more traditional pumps in these demanding settings.

Traditional centrifugal pumps have vanes which are designed to shear and sling the liquid in order to impart centrifugal force. These typical centrifugal pumps have problems with cavitation, clogging, binding, and high wear when used for pumping slurries, liquids with solids, high viscosity fluids, and fluids with entrained air or gas. Because of the shortcomings, centrifugal pumps are available with modified impellers which have no vanes or have fractional vanes to avoid complete impingement on the liquid. These are also known as disc pumps. Disc pumps are commonly chosen to transport liquids with slurries having a great amount of solids, high viscosity, and slurries with entrained air or gas. They are also used to pumps the shear-sensitive liquids and to prevent emulsification or degradation of the liquid.

A disc pump is comprised of an outer housing with an inner cylindrical rotor chamber having an inlet at one end and an outlet at its outer periphery. A rotor assembly in the chamber is composed of at least two parallel spaced discs disposed co-axially in the chamber and connected together for rotation about the center axis. The inner opposing faces of the discs are spaced a pre-determined distance apart and a series of raised ribs or vanes are provided on at least one of the opposing faces when the vane height is less than the disc spacing. The first disc is known as the drive disc and is attached to the pump shaft. The other discs are attached to the drive disc via pins or posts. The drive disc is solid. The additional disc has a hole in the center to allow the liquid to enter.

The inherent design of a disc pump removes typical vanes from the impeller and uses friction or surface tension to propel the liquid. This design creates slippage and is very inefficient. Some disc pump designs have incorporated rectangular ribs to make the discs more efficient. These ribs start at the center of the disc and extend to the outer diameter of the disc. Despite these modifications, these improvements are still highly inefficient because of dead zones created by vortices on the back of the rectangular ribs and lack of surface area to propel the liquid in a laminar manner.

FIGS. 1 and 2 show an example of a prior art disc pump. This disc pump 10 in FIG. 1 has a pump housing 12 formed by a front wall 14, a back wall 18 and a peripheral wall 20. The disc pump 10 has an inlet 16 located near the center of the front wall 14. The inlet 16 is aligned with the longitudinal axis of the pump drive shaft 32. The inlet 16 is a central, coaxial inlet. The inlet 16 supplies feed flow from one side of the housing 12 or from both sides of the housing.

The housing 12 has an outlet 22 that is positioned on or within the peripheral wall 20. The housing 12 is of a generally cylindrical shape. The peripheral wall 20 forms the outer surface of the cylinder. A first disc 26 and a second disc 28 are also shown in FIG. 1. The first disc 26 is shown as being near the back wall 18 and is operatively connected to the drive shaft 32. Any type of rotational drive member may be used to rotate the discs. The second disc 28 is shown near the front wall 14. The two discs are connected by pins 30. The connecting members between the discs must be of sufficient strength to allow the first disc 26 to cause the second disc 28 to rotate. Only the first disc 26 is directly connected to the rotational drive member. The pins 30 should be of a relatively small cross-section in order to reduce the turbulence caused by the rotation of the discs through the housing 12 during the operation of the pump.

The pump 10, shown in FIG. 1, is of a type known in the prior art. The first disc 26 and the second disc 28 are flat and smooth. In operation, the drive shaft 32 is rotated by a driving force which thereby rotates the discs 26 and 28 within the housing 12. When the discs 26 and 28 begin to rotate, a thin boundary layer of water near the outer surface of the discs 26 and 28 will begin to rotate. The adhesion of the water (or other liquid) to the solid surface of each disc creates drag that tends to pull a thin boundary layer of water along with the disc as it rotates. The two discs 26 and 28, each cause a thin boundary layer water to begin rotating in the same direction as the discs.

The region between the discs has the viscosity of the fluid that accounts for the generation of flow. The liquid between the discs 26 and 28 may be understood as many thin sheets of liquid, wherein each thin sheet is parallel to the two rotating discs. Moving away from the discs 26 and 28 a toward the center of the housing 12, it can be seen that the two boundary layers are rotated in same direction as the discs 26 and 28 due to the adhesion forces between the discs 26 and 28 and the boundary layers. The next thin layers of water are in contact with the boundary layers. Due to the viscosity of the liquid, these next layers of water will begin to rotate with the boundary layers. Each thin layer of water begins to rotate because the water immediately around it is rotating. This process continues until all of the water in the housing 12 is rotating in the same direction as the discs 26 and 28.

As the liquid rotates with the discs, the water experiences centrifugal forces which tend to force the water radially outwardly from the axial center of the housing 12. The water moves in a generally outward spiral from the axial center to the outer peripheral region of the housing 12 (where the outlet 22 is positioned). The water is pumped from the central coaxial inlet 16 toward the outlet 22. The liquid entering the pump 10 has entrained gas or solid particles 24, which are moved in the same outward spiral pattern as the liquid. The entrained matter 24 moves through the pump housing 12 with little, if any, contact with the rotating discs 26 and 28.

FIG. 2 shows a cutaway view of the prior art shown in FIG. 1. In FIG. 2, the disc pump 10 has a housing 12 formed by first wall 14, a second wall 18 and a peripheral wall 20. The central coaxial inlet 16 and the outlet 22 are of a configuration similar to that shown in FIG. 1. The first disc 26, the second disc 28, and connecting pins 30 are also shown, along with the drive shaft 32. A thrust bearing assembly 34 and a shaft seal assembly 36 are also shown.

The inner surface of the first disc 26 is covered with small, recessed dimples 38. These dimples 38 may also be present on the inner surface of the second disc 28. The dimples 38 create a markedly different result when the discs rotate. When the dimpled discs rotate through the liquid, the many dimples create small surface disturbances in the liquid near the disc surfaces. Small eddy currents are formed as the liquid enters and leaves the many dimples 38. Each dimple 38 is small and shallow and thus creates only a small disturbance to the liquid near the disc surface. The collective impact of many such small disturbances is a substantially more turbulent flow within the boundary layer. This turbulence produces a thicker boundary layer.

Multiphase fluids, such as gaseous and liquid two-phase fluids, exist in many areas of technology, such as oil production, wastewater plants, petrochemical plants, and pharmaceutical and mining operations. In oil production, pumps are often used in wells to move crude oil from deep reservoirs. Most pumps use impellers and diffusers in different combinations called "stages". A portion of the flow (i.e. kinetic energy) is slowed and converted to pressure as the fluid passes through the diffuser. A common problem with these typical pumps in multiphase fluids is that the induced centrifugal force separates the gas from the liquid. Microbubbles will then aggregate into macro bubbles. The end result is vapor locking. This vapor locking on the pump will cause cavitation. This can lead to reduced performance, vibration, and a breaking down of the pump. As the gas-to-liquid percentage increases, so does the vapor locking phenomenon. There have been many pumps designed to attempt to overcome this problem. Some of these are helical-axial pumps, progressive cavity pumps, and twin screw pumps. These pumps have limited capabilities and very large maintenance requirements.

In the past, various patents have issued with respect to such disc pumps. For example, U.S. Pat. No. 1,013,248, issued on Jan. 2, 1912, describes a centrifugal pump which is the combination of a pump casing, a rotatable shaft mounted therein, and a series of friction or impeller discs carried by the shaft. Curved vanes are secured between the impeller discs near the periphery thereof. The vanes overlap each other, but leave a gradually narrowing space from the center outwardly. The impeller discs have interior rounded edges and a means for fastening the impeller structure together.

U.S. Pat. No. 4,773,819, issued on Sep. 27, 1988 to M. I. Gurth, describes a rotary disc slurry pump that includes a rotary pump having a plain disc impeller disposed in a cylindrical chamber of a housing with an inlet coaxial of the impeller into the housing and a substantially square outlet from the periphery of the chamber. A rotor is arranged to provide a substantially unobstructed passage between the inlet and the outlet of the pump.

U.S. Pat. No. 5,355,993, issued on Oct. 18, 1994 to A. G. Hay, teaches an apparatus for transporting and metering particulate material. This apparatus includes a transport duct having an inlet, an outlet, and at least one moving surface located therebetween and having a downstream facing drive surface. A motive device for moving the moving surface between the inlet and the outlet is provided. The particulate matter is compacted sufficiently to cause the formation of a bridge composed of substantially interlocking particulates spanning the width of the transport duct. The bridging of the particulates causes the particulates to become semi-hydrostatic in nature such that the force exerted by the downstream facing drive surface upon the particulates within the transport duct drives the entire mass of material through the transport duct toward the outlet.

U.S. Pat. No. 5,385,443, issued on Jan. 31, 1995 to R. Dufour, shows a centrifugal liquid pump of the rotary disc type that incorporates a gas injection assembly. The gas injection assembly allows up to 15% per volume of the gas to be mixed with the pumped liquid. The gas injection is achieved with a gas feed pipe that enters the pump through its axial inlet with a plurality of gas injectors that project from the gas feed pipe radially within the impeller.

U.S. Pat. No. 5,551,553, issued on Sep. 3, 1996 to A. G. Hay, discloses an apparatus for transporting particulate material. A housing is provided and includes a wall defining an inlet and a wall defining an outlet spaced downstream from the outlet. A duct is enclosed in the housing between the inlet and the outlet. The duct is formed between first and second substantially opposed drive walls movable relative to the housing from the inlet toward the outlet and at least one arcuate wall extending between the inlet and the outlet. The drive walls have a greater surface area for contacting the solid material than the arcuate walls. The drive walls rotate relative to an axis. An assembly is provided for positioning the second drive wall in the housing for rotation in a plane at an angle relative to the axis such that the distance between the first and second drive walls adjacent to the inlet is greater than the distance downstream from the inlet when the drive walls are moving.

U.S. Pat. No. 7,044,288, issued on May 16, 2006 to Baer et al., shows a bulk material pump having a housing and a rotatable drive rotor for transporting material from an inlet to an outlet of the housing. The drive rotor has a hub. Drive discs extend away from the hub toward an inner wall of a housing. The distance between the circumferential edges of the drive discs and the inner wall of the housing increases from the inlet to the outlet in the direction of rotation of the drive rotor. A low-friction brush seal is disposed on the periphery of the drive discs so as to seal the area between the periphery of the drive discs and the inner wall. A material scraper having a flexible tip is mounted in the housing and extends into the drive rotor between the drive discs.

U.S. Pat. No. 8,210,816, issued on Jul. 3, 2012 to S. Geldenhuys, teaches an impeller for a centrifugal pump. The centrifugal pump includes a pump casing within which an impeller is mounted for rotation, in a cantilevered fashion, on a shaft. The casing has an axial inlet and a peripheral volute around the impeller leading to an outlet. The impeller has axially spaced annular sides with radially outwardly arranged, rearwardly curved, vanes between the sides. A clearing that corresponds to sides of the casing is located outwardly of the sides. Auxiliary vanes are provided to generate a pressure gradient to prevent or counteract leakage of working fluid. Leading faces of the auxiliary vanes slope relative to and perpendicular to the sides. The leading edges are at an obtuse angle to the sides.

U.S. Patent Application Publication No. 2007/0258824, published on Nov. 8, 2007 to Pacello et al., provides a rotor for viscous or abrasive fluids. This rotor comprises a drive disc and a plurality of driven discs in a stack. The stacked discs are in spaced relationship along a rotational axis so as to form inter-disc spaces. A centrally-positioned aperture is provided in each of the driven discs so as to open into the inter-disc spaces. A hub is connected to the drive disc for communication with a driveshaft. There is a plurality of axial vanes within the apertures and attached to the discs whereby rotation of the rotor causes the fluids to be drawn into the apertures and then into the inter-disc spaces.

U.S. Patent Application Publication No. 2008/0213093, published on Sep. 4, 2008 to J. Guelich, discloses an impeller for pumps in which a rotary wheel includes an intermediate wall at which one or more vanes are provided on each side thereof. Passage openings are formed in the intermediate wall in order to distribute a desired pump flow into the vanes on both sides of the intermediate wall.

U.S. Patent Application Publication No. 2012/0014779, published on Jan. 16, 2012 to C. D. Gillim, teaches a disc pump having one or more rotating discs within a housing. The discs have a plurality of relatively small surface perturbations covering at least one-half of one side of their surface. The perturbations may be recessed or raised. In operation, a boundary layer is formed near the surface of the rotating discs. The fluid within the pump flows in a circular and outward direction, thus moving the fluid from a central coaxial inlet to an outlet located at the peripheral wall of the housing. The surface perturbations produce turbulence within the boundary layer during operation.

U.S. Patent Application Publication No. 2015/0308446, published on Oct. 29, 2015 to Koivikko et al., shows an impeller for a centrifugal pump in which the impeller includes a front shroud, a rear shroud, and one or more working vanes therebetween. The front shroud has a front surface opposite to the face having the working vanes. The rear shroud has a rear face opposite to the face having the working vanes. The front shroud has an outer circumference of the plurality of front pump-out vanes attached to the front face of the front shroud. The rear shroud has a plurality of rear pump-out vanes attached to the rear face of the rear shroud.

International Publication No. WO2014/073976, published on May 15, 2014 to S. Ree, discloses an impeller for a centrifugal pump for pumping drill fluid containing cuttings. The impeller has a rear side wall and a front side wall. Arranged between the rear side wall and the front side wall is a number of vanes with an outer edge and a vane with in the axial direction. At least one of the periphery of the rear side wall or the periphery of the front side wall projects by radial distance beyond the outer edge of the vanes. The radial distance is at least 0.5 times the vane width.

The present Applicant is the owner of U.S. Pat. No. 11,680,578, issued on Jun. 20, 2023 to J. Jimenez. This patent describes an impeller for a disc pump that has a drive disc with a connector for joining to a shaft of the disc pump, a driven disc affixed to the drive disc so as to define a space therebetween, and a plurality of wing vanes formed in the face of at least one of the drive disc and the driven disc. The drive disc has a face facing a face of the driven disc. The drive disc extends in generally parallel planar relationship to the driven disc. The plurality of wing vanes radiate across the face toward an outer diameter of one of the drive disc and the driven disc. Each of the wing vanes has a portion extending outwardly beyond the outer diameter of the drive disc and the driven disc.

U.S. Pat. No. 7,553,124, issued on Jun. 30, 2009 to the present inventor, teaches a pump for pumping high-viscosity liquids, slurries and liquids with solids. The pump has a housing, a chamber formed within the housing, a first discoidal member positioned in the chamber, a second discoidal member position in the chamber, connecting rods, connecting a periphery of the first discoidal member to a periphery of the second discoidal member, and a drive for rotating the first discoidal member and the second discoidal member. The first discoidal member is either a recessed impeller or half-regular closed centripetal impeller.

U.S. Patent Application Publication No. 2016/0215798, published on Jun. 28, 2016 to Gilliam et al., discloses a hydraulic-driven pump having one or more rotating discs within a housing. The housing is sealed and hydraulic fluid under pressure supplied to the housing maintains a positive pressure within the housing. The pump is mechanically-driven by hydraulic fluid. The rotating disc can include small surface perturbations.

U.S. Patent Application Publication No. 2015/0328603, published on Nov. 19, 2015 to Smith, et al., teaches a cavitation device supplied by disc pump with fluids for mixing. A cavitation rotor has an array of cavities on its cylindrical surface. The cavitation rotor is fixed to a shaft for rotation by motor. The disc pump and the cavitation device are in the same housing. At least one disc is spaced from and attached to the rotor near the inlet end of the cylindrical housing so as to rotate with the rotor. A central hole in the disc permits fluid to enter the space between the disc and the rotor. The fluid is flung toward the peripheral space between the rotor and the cylindrical housing, where is it is subjected to cavitation, and then passed to an outlet. The cavitation pump is especially useful for mixing oil field fluids.

It is an object of the present invention to provide a multistage disc pump without vanes in order to allow gas and air buoyancy to naturally exert upward forces so as to increase the percentage of gas-to-liquid that can be pumped.

It is another object of the present invention to provide a multistage disc pump that moves liquids with slurries, solids, and entrained air or gas while achieving the required pressures by multi-staging.

It is another object of the present invention to provide a multistage disc pump that can pump shear-sensitive liquids while achieving the required pressures by multi-staging.

It is another object of the present invention to provide a multistage disc pump that prevents emulsification or degradation of the liquid while achieving the required pressures by multi-staging.

It is another object of the present invention to provide a multistage disc pump that minimizes eddy currents and recirculation to provide a more efficient process and to decrease the carbon footprint of the process.

It is still another object of the present invention to provide a multistage disc pump without close tolerances that creates low-pressure areas where entrained bubbles can group together and grow.

It is another object of the present invention to provide a multistage disc pump that minimizes the centrifugal effect so as to avoid the separation of the entrained air/gas from the liquid in order to move the liquid more efficiently.

It is another object of the present invention provide a multistage disc pump that avoids vapor locks.

It is still another object of the present invention to provide a multistage disc pump that has low maintenance requirements.

It is still a further object of the present invention to provide a multistage disc pump that effectively moves high viscosity liquids with gases.

These and other objects and advantages of the present invention will become apparent from a reading of the attached specification and appended claims.

SUMMARY OF THE INVENTION

The present invention is a pump for use in a multistage disc pump for multiphase fluids. The pump comprises a bowl having an interior volume and a disc set rotatably mounted in the interior volume of the bowl. The bowl has an inlet and an outlet. The inlet is adapted to receive the multiphase fluid therein. The outlet is adapted to pass a pumped multiphase fluid outwardly of the bowl. The disc set has a drive disc and a driven disc. At least one of the drive disc and the driven disc has a plurality of micro vanes formed thereon or affixed thereto. The plurality of micro vanes extend toward another of the drive disc and the driven disc. The plurality of micro vanes are adapted to interact with the multiphase fluid passing through the bowl. A lodging is positioned in the interior volume of the bowl. The lodging is positioned in spaced relation to an inner wall of the bowl. The lodging supports the disc set in the interior volume of the bowl.

A plurality of solid vanes are affixed to at least one of the lodging and the inner wall of the bowl. The plurality of solid vanes are adapted to interact with the multiphase fluid flowing from the inlet toward the outlet of the bowl. The plurality of solid vanes, in the preferred embodiment, are fixed to the inner wall of the bowl and to the lodging. Alternatively, a first plurality of micro vanes can be affixed to the lodging and a second plurality of micro vanes can be affixed to the inner wall of the bowl.

The lodging has an interior passageway formed therein. A shaft extends through this interior passageway of the lodging and is affixed to the disc set. The disc set rotates in correspondence with the rotation of the shaft. The lodging defines a curved passageway with the bowl. The curved passageway is defined between the exterior of the lodging and the inner wall of the bowl. The curved passageway extends from the disc set toward the outlet of the bowl. The curved passageway is adapted to allow the multiphase fluid to flow around an outer diameter of the lodging.

The disc set has a conical configuration. The driven disc of the disc set bears closely against an inner wall of the bowl. The driven disc is connected to the drive disc by a post such that the driven disc rotates in correspondence with the drive disc. The drive disc has a plurality of micro vanes extending toward the driven disc. Additionally, the driven disc has a plurality of micro vanes extending toward the drive disc. The plurality of micro vanes of the drive disc extends for no more than a distance between the drive disc in the driven disc. Similarly, the plurality of micro vanes of the driven disc extend for no more than the distance between the drive disc and the driven disc. Each of the plurality of micro vanes can have an arcuate shape.

The drive disc is disposed co-axially with respect to the driven disc. The drive disc is affixed to the shaft so as to rotate in correspondence with the rotation of the shaft. The drive disc has a hole in the center thereof. This hole is disposed so as to face the inlet of the bowl. In an alternative embodiment, the driven disc can comprise a plurality of driven discs.

The outlet of the bowl extends from the lodging to an end of the bowl. The outlet widens in diameter from the lodging toward the end of the bowl. In an embodiment of the present invention, a helical-axial impeller is positioned adjacent the inlet of the bowl. This helical-axial impeller is adapted to maintain a pressure of the multiphase fluid. The disc set is positioned in the bowl so as to drive the multiphase fluid from the disc set into and along the curved passageway of the bowl.

Fundamentally, the multistage disc pump of the present invention is comprised of an outer conically-shaped bowl with an integral diffuser, which houses an inner cylindrical rotor chamber having an inlet at one end and an outlet at the other end. The rotor assembly in the chamber is composed of at least one conically-shaped disc set disposed coaxially in the chamber and connected for rotation around the center axis. The inner opposing faces of the discs are spaced a pre-determined distance apart. A series of raised ribs or micro vanes are provided at least one of the opposing faces. The height of the micro vanes is less than the space between the discs. The first conical disc is the drive disc and is attached to the pump shaft. The other disc is the driven disc. This driven disc is also conical and is attached to the drive disc. The drive disc is solid. The additional driven disc can have a hole in the center so as to allow the air to enter.

The pump can be composed of one stage or a plurality of stages. The suction is at one end and the discharges are through the coned disc set and diffuser (an integral part of the bowl). In those circumstances where the suction pressure is low, and where the gas-to-liquid percentage is high, the disc set can have an inducer or a helical-axial impeller attached to the suction and or the heat stage. This configuration assists in incrementing the suction pressure to each stage so as to keep the pressure high in order to maintain the entrained gas and to avoid the separation of the entrained gas from the liquid. The pump arrangement can be vertical or horizontal. The bowl/diffuser can have solid vanes or micro vanes. The size and exact dimensions and number of the micro vanes in the disc set and in the bowl/diffuser can vary.

The angle and geometry for the micro vanes and inducer can vary according to the requirements of the fluid being pumped.

The present invention maintains the same advantages of a single stage disc pump. These advantages include low maintenance, very little impingement and a very minor centrifugal effect that is imparted. The minor centrifugal effect keeps the gases in entrained bubbles and conveys the gas forward. The tapered design of the bowl/diffuser is used to slow the flow and increase the pressure. There are various configurations available, depending on the particular application. The arrangements can either be vertical or horizontal. A vertical below-ground design can be used for producing oil wells so as to allow the effective movement of high-viscosity crude oil with gas to the surface. The open vanes do not contour the viscous fluid through tight geometries and allows the natural buoyancy of the gases to pass through with minimal centrifugal effect. A horizontal above-ground application will adapt itself to similar above-ground processes. A similar in-line design is available for typical petrochemical or wastewater applications.

DETAILED DESCRIPTION OF THE INVENTION

Figure 1:
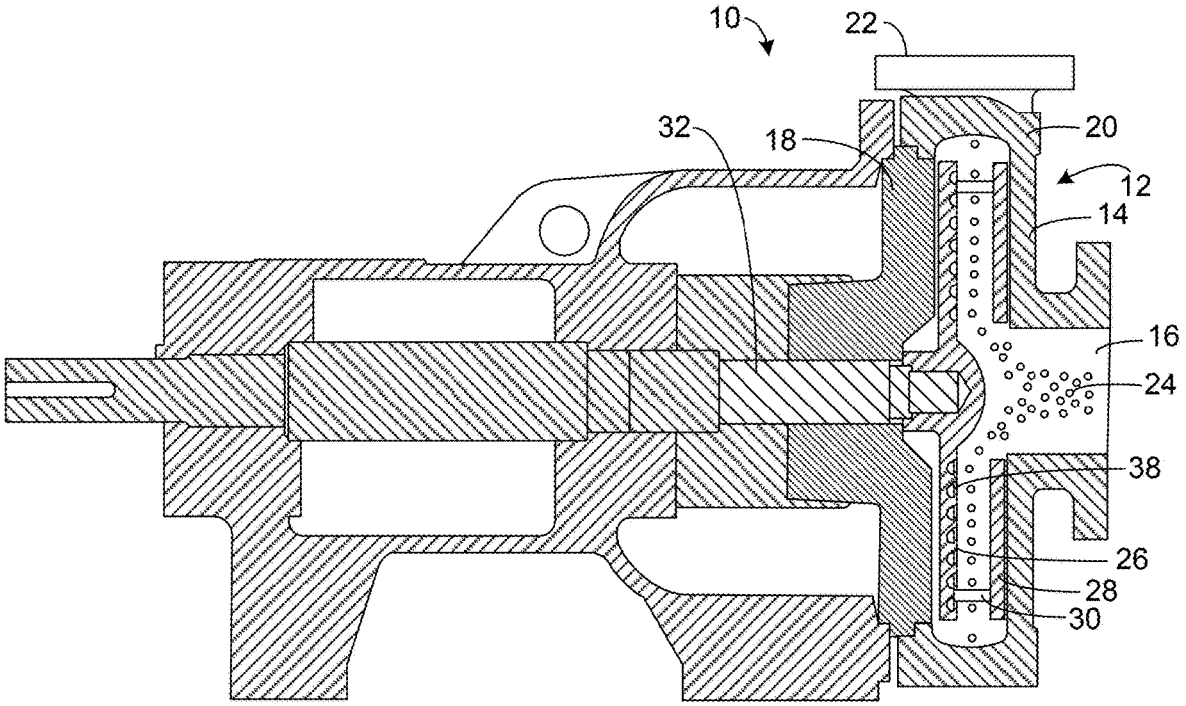
FIG. 1 PRIOR ART
FIG. 1 is a cross-sectional side view of a disc pump in accordance with the prior art.
Figure 2:
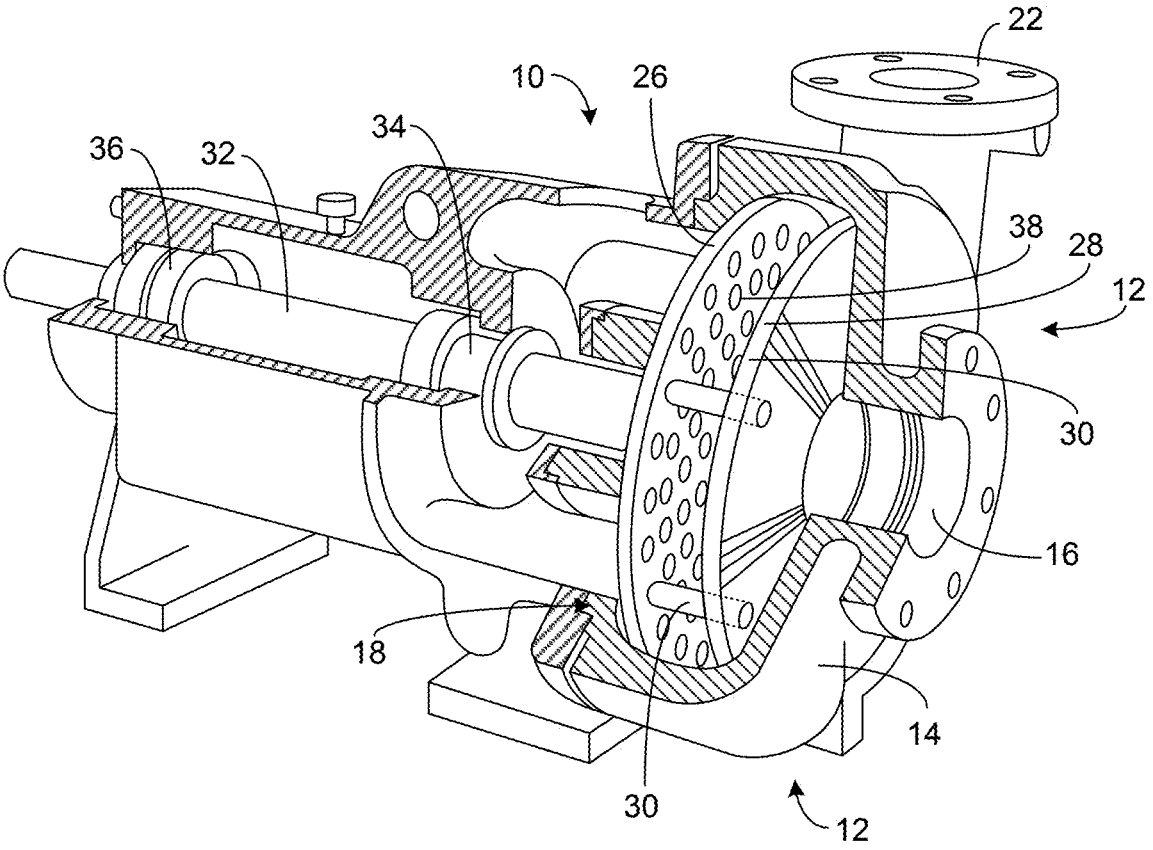
FIG. 2 PRIOR ART
FIG. 2 is a cutaway upper perspective view of the disc pump of FIG. 1.
Figure 3:
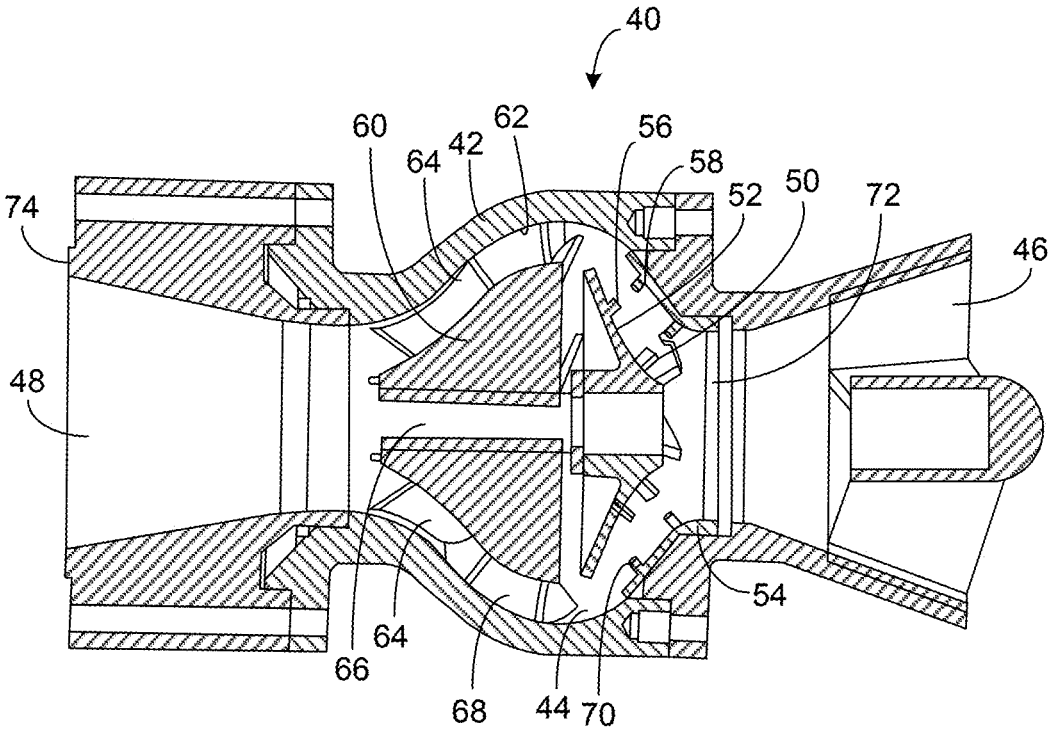
FIG. 3 is a cross-sectional view of the disc pump of the present invention.

Referring to FIG. 3, there is shown the disc pump 40 in accordance with the preferred embodiment of the present invention. The disc pump 40 includes a bowl 42 having an interior volume 44. The bowl has an inlet 46 and an outlet 48. The inlet 46 is adapted to receive the multiphase fluid therein. The outlet 48 is adapted to pump the multiphase fluid outwardly of the bowl 42. A disc set 50 is rotatably mounted in the interior volume 44 of the bowl 42. This disc set 50 includes a drive disc 52 and a driven disc 54. It can be seen that the drive disc 52 has a plurality of micro vanes 56 formed thereon or affixed thereto. The plurality of micro vanes 56 extend toward the driven disc 54. This plurality of micro vanes 56 are adapted interact with the multiphase fluid passing through the bowl.

FIG. 3 shows that there are also a plurality of micro vanes 58 that are formed or affixed to the driven disc 54. This plurality of micro vanes 58 extends toward the drive disc 52. This plurality of micro vanes 58 on the driven disc 54 are adapted to interact with the multiphase fluid passing through the bowl 42.

A lodging 60 is positioned in the interior volume 44 of the bowl 42. The lodging 60 is positioned in spaced relation to the inner wall 62 of the bowl 42. The lodging 60 supports the disc set 52 in the interior volume 44 of the bowl 42.

A plurality of solid vanes 64 are affixed to the lodging 60 and extend toward the inner wall 62 of the bowl 42. The plurality of solid vanes 64 are adapted to interact with the multiphase fluid flowing from the inlet 46 toward the outlet 48 of the bowl 42. The plurality of solid vanes 64 can be affixed to both the inner wall 62 of the bowl 42 and to the lodging 60. Alternatively, the plurality of solid vanes 64 can be affixed to the inner wall 62 and extend toward the outer wall of the lodging 60.

The lodging 60 has an interior passageway 66 formed therein. A shaft (as will be described and shown hereinafter) extends through the interior passageway 66 of the lodging 60 and is affixed to the disc set 50. The disc set 50 will rotate in correspondence with a rotation of the shaft. The lodging 60 also defines a curved passageway 68 within the bowl 42. The curved passageway 68 is defined between an exterior of the lodging 60 and the inner wall 62 of the bowl 42.

In FIG. 3, it can be seen that the disc set 50 has a conical configuration. The driven disc 54 of the disc set 50 will bear closely against the inner wall 62 of the bowl 42. The driven disc 54 is connected to the drive disc 52 by a post or pin 70 such that the driven disc 54 rotates in correspondence with the drive disc 52.

FIG. 3 shows that the drive disc has a plurality of micro vanes 56 extending toward the driven disc 54. The driven disc 54 has a plurality of micro vanes 58 extending toward the drive disc 52. It can be seen that the plurality of micro vanes 56 of the drive disc 52 extend for no more than the distance between the drive disc 52 and the driven disc 54. Similarly, the plurality of micro vanes 58 of the driven disc 54 extend for no more than the distance between the drive disc 52 and the driven disc 54. The drive disc 56 is disposed co-axially with respect to the driven disc 54. The driven disc 54 has a hole 72 at a center thereof. This hole is disposed so as to face the inlet 46 of the bowl 42. It should be noted that the driven disc 54 can comprise a plurality of driven discs.

FIG. 3 shows that the outlet 48 of the bowl 42 extends from the lodging 60 toward an end 74 of the bowl 42. The outlet 48 widens in diameter from the lodging 60 toward the end 78 of the bowl 42. The disc set 50 is positioned in the bowl 42 so as to drive the multiphase fluid from the disc set 50 into and along the curved passageway 68 of the bowl 42.

Figure 4:
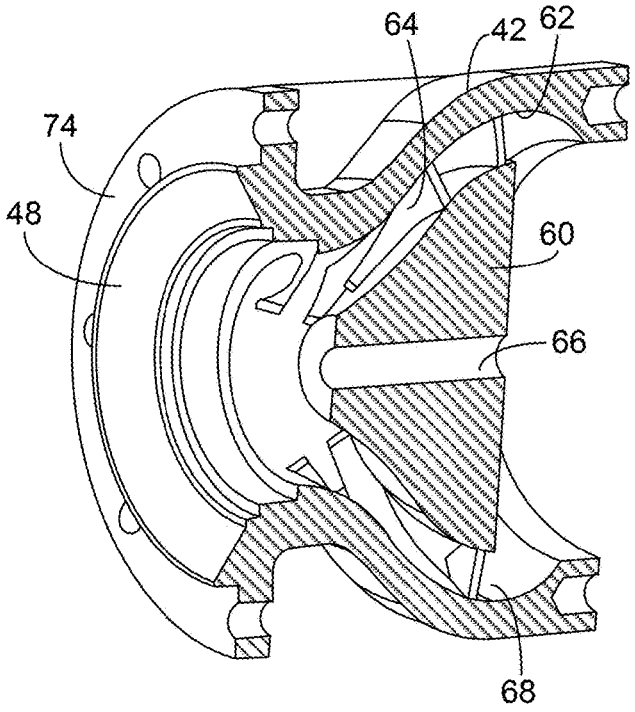
FIG. 4 is an upper perspective cross-sectional view showing the configuration of the bowl and lodging of the disc pump of the present invention.

FIG. 4 shows an isolated cutaway view of the bowl 42 and the lodging 60. In particular, FIG. 4 shows that the outlet 48 of the disc pump 40 is at the end 74 of the bowl 48. The bowl 42 will have a generally hourglass configuration extending toward the outlet 48. The plurality of vanes 64 are fixed to the exterior of the lodging 60 and extend toward the inner wall 62 of the bowl 42. Ultimately, this plurality of vanes 64 are located in the curved passageway 68 that is defined between the exterior of the lodging 60 and the inner wall 62 of the bowl 42. FIG. 4 further shows that the lodging 60 as an interior passageway 66 adapted to receive the shaft of the multistage pump therethrough.

Figure 5:
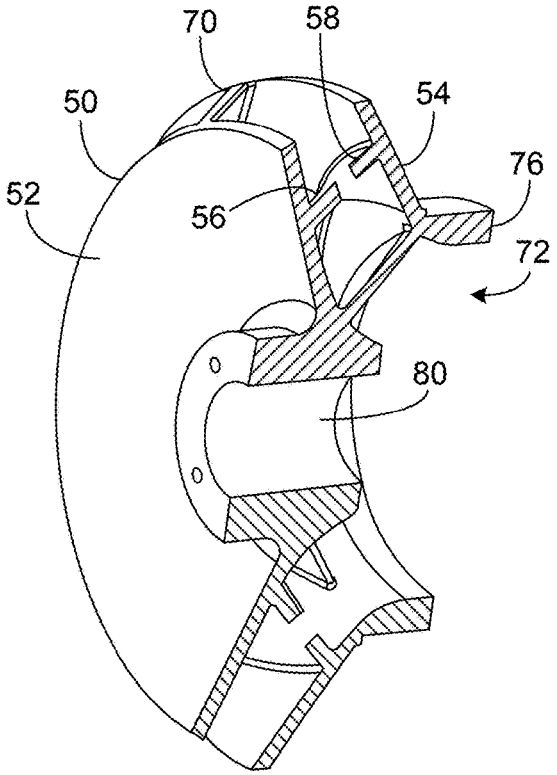
FIG. 5 is an upper cutaway perspective view of the disc set as used in the disc pump of the present invention.

FIG. 5 is a cutaway view showing the disc set 50 of the present invention. The disc set 50 includes the drive disc 52 and the driven disc 54. A pin or post 70 extends between the drive disc 52 and the driven disc 54. A plurality of micro vanes 56 extend inwardly from the inner surface of the drive disc 52 toward the driven disc 54. Similarly, the plurality of micro vanes 58 will extend from an inner wall of the driven disc 54 toward the drive disc 52. It can be seen that each of the micro vanes 56 and 58 has a height that is less than the distance between the drive disc 52 and the driven disc 54. In the preferred embodiment of the present invention, the micro vanes 56 and 58 are aligned with each other with a small space therebetween. In another alternative embodiment, the micro vanes 58 can be disposed in an offset relationship to each other.

The disc set 50 includes a central passageway 80 that is adapted to receive the exterior of the shaft therein. The driven disc 54 includes a hole 72 at the end 76 thereof. The drive disc 52 is a solid disc. In general, the driven disc 54 is also a solid disc, but for the hole 72. Hole 72 allows the liquids passing through the inlet 46 of the pump to enter the interior of the disc set 50.

Figure 6:
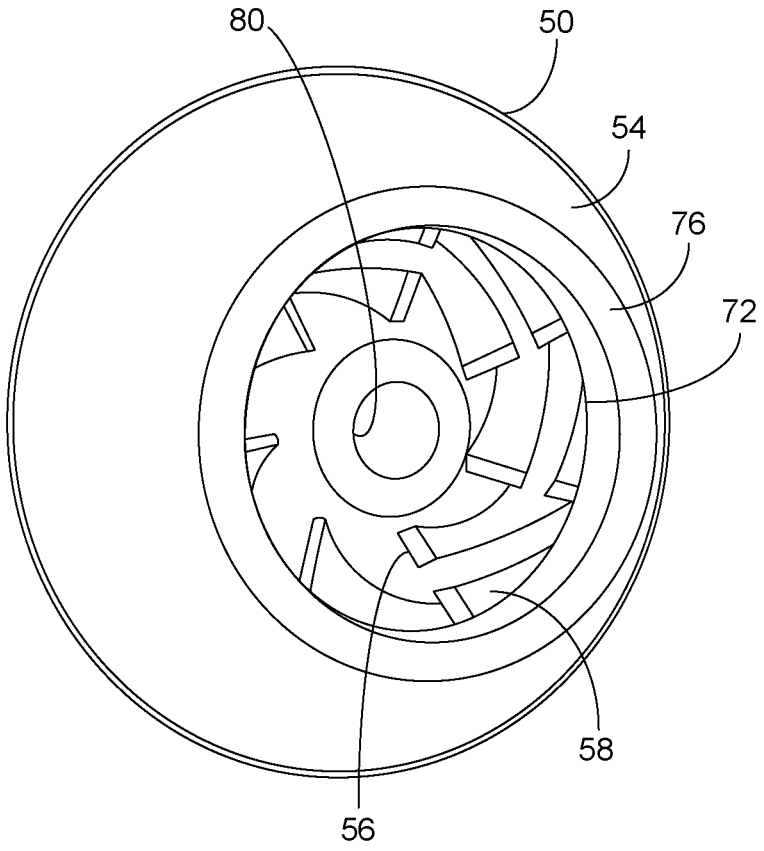
FIG. 6 is a perspective bottom view of the disc set as used in the disc pump of the present invention.

FIG. 6 illustrates a bottom view of the disc set 50. In this bottom view, it can be seen that the disc set 50 has a conical configuration. The driven disc 54 has an end 76 that defines an opening 72 therein. The plurality of micro vanes 58 are illustrated as affixed to the driven disc 54. Another plurality of micro vanes 56 will be affixed to the drive disc 52. Each of the micro vanes 52 and 54 has a generally arcuate configuration. The disc set 50 includes a central passageway 80 that is adapted to fasten to the shaft of the multistage pump.

Figure 7:
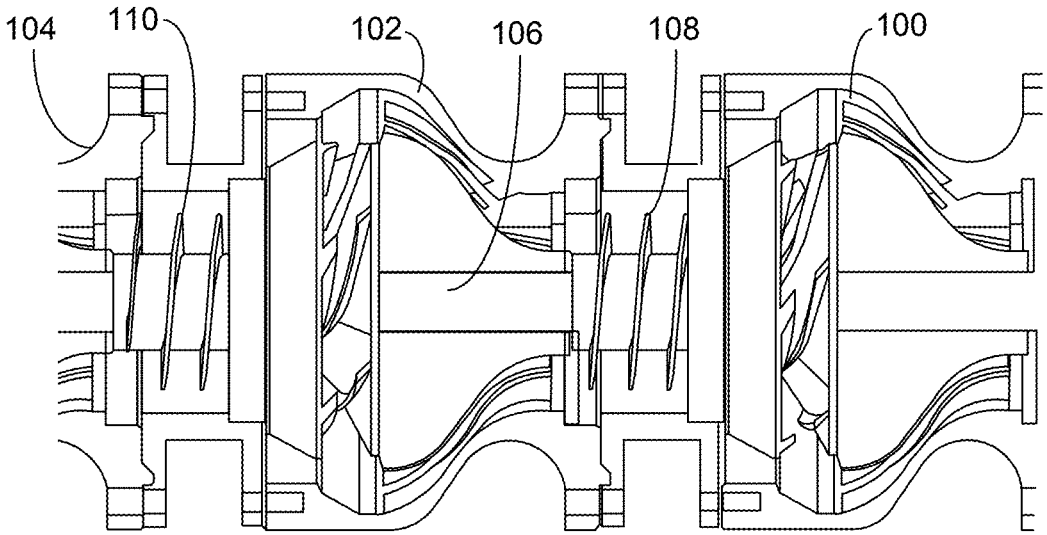
FIG. 7 is a side elevation of view showing the disc pump of the present invention as used in association with a multistage disc pump assembly.

FIG. 7 shows that there are a plurality of disc pumps 100, 102 and 104 arranged in a multi-stage pump configuration. Shaft 106 will extend between each of the pumps, 100, 102 and 104. Shaft 106 can be driven in rotation by any prime mover. The shaft 106 will serve to drive the disc set 50 in rotation. Each of the pumps, 100, 102 and 104 is bolted together in coaxial relationship. A helical-axial impeller 108 is provided between the pumps 100 and 102. Similarly, another helical-axial impeller 110 is formed between the pumps 102 and 104. The helical-axial impeller is adapted to maintain the pressure of the multiphase fluid within the multistage pump assembly.

Figure 8:
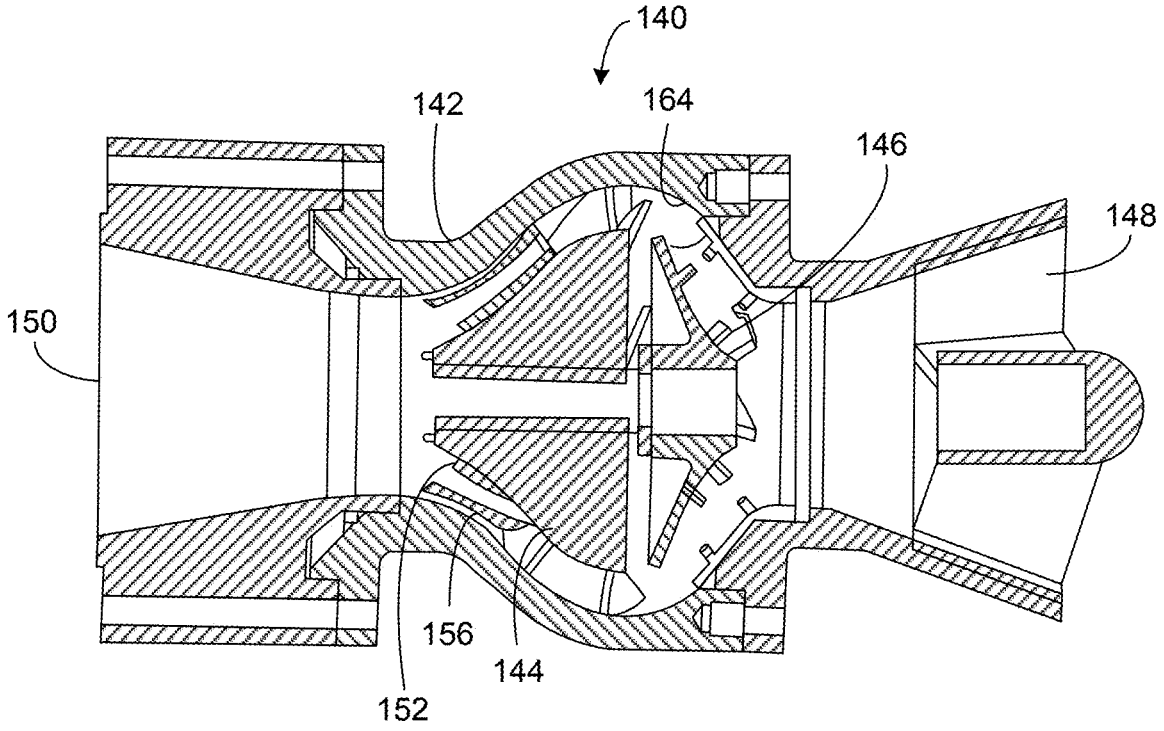
FIG. 8 is a cross-sectional view of the desktop of the present invention showing the use of micro vanes on the lodging and the bowl.

FIG. 8 shows an alternative embodiment of the present invention. In particular, FIG. 8 shows the disc pump 140 having the bowl 142, the lodging 144, and the disc set 146. The bowl 142 has inlet 148 at one end and an outlet 150 at an opposite end. The disc set 146 has the configuration of the previous embodiment of the present invention. However, FIG. 8 shows that the lodging 144 will have a plurality a plurality of micro vanes 152 affixed to an exterior surface thereof. The inner wall 164 of the bowl 142 will have a plurality of micro vanes 156 affixed thereto in a location corresponding to the location of the plurality of micro vanes 152.

In general, the multistage disc pump of the present invention has the outer conically-shaped bowl with an integral diffuser, which houses an inner cylindrical rotor chamber having an inlet at one end and an outlet at the other end. The rotor assembly in the chamber is composed of at least one conically-shaped disc set disposed co-axially in the chamber and connected for rotation about the center axis. The inner opposing faces of the discs are spaced a predetermined distance apart. A series of raised ribs or micro vanes are provided on at least one of the opposing faces. The height of the micro vanes is less than the space between the discs. The first conical disc is the drive disc and is attached to the pump shaft. The other disc is the driven disc. This driven disc is also conical and is attached to the drive disc by pins or posts. The drive disc is solid. The driven disc has a hole in the center thereof so as to allow the liquid to enter.

The pumps can be composed of one stage or a plurality of stages (such as shown in FIG. 7). The suction is at one end and the axial discharge is at the opposite end. The helical-axial impeller can be attached toward the suction end or to each stage where the suction pressure is lower where the gas-to-liquid percentage is high. This configuration assists in incrementing the suction pressure to each stage so as to keep the pressure high in order to maintain the entrainment of the gas and avoid allowing the gas to separate from the liquid.

The foregoing disclosure and description of the invention is illustrative and explanatory thereof. Various changes in the details of the illustrated construction can be made within the scope of the appended claims without departing from the true spirit of the invention. The present invention should only be limited by the following claims and their legal equivalents.

The invention claimed is:

1. A pump for use in a multistage disc pump for multiphase fluids, the pump comprising:

a bowl having an interior volume, said bowl having an inlet and an outlet, the outlet being longitudinally aligned with the inlet at an opposite end of said bowl from said inlet, the inlet adapted to receive the multiphase fluid therein, the outlet adapted to pass a pumped multiphase fluid outwardly of said bowl;

a disc set rotatably mounted in the interior volume of said bowl, said disc set having a drive disc and a driven disc, at least one of the drive disc and the driven disc having a plurality of vanes formed thereon or affixed thereto, the plurality of vanes extending toward another of the drive disc and the driven disc, the plurality of vanes being adapted to interact with the multiphase fluid passing through said bowl, wherein the plurality of vanes of said drive disc extend for no more than a distance between said drive disc and said driven disc, the plurality of vanes of said driven disc extending for no more than the distance between said drive disc and said driven disc;

a lodging positioned in the interior volume of said bowl, the lodging being positioned in spaced relation to an inner wall of said bowl, said lodging supporting said disc set in the interior volume of said bowl; and a plurality of fixed vanes affixed to said lodging and the inner wall of said bowl, said plurality of fixed vanes adapted to interact with the multiphase fluid flowing from the inlet to the outlet of said bowl, wherein said lodging defines a curved passageway between an exterior of said lodging and the inner wall of said bowl, wherein the curved passageway extends from said disc set toward the outlet of said bowl, the curved passageway adapted to allow the multiphase fluid to flow around the outer diameter of said lodging.

2. The pump of claim 1, wherein said lodging has an interior passageway formed therein, the pump further comprising:

a shaft extending through the interior passageway of said lodging and being affixed to said disc set, said disc set rotating in correspondence with a rotation of said shaft.

3. The pump of claim 2, wherein the drive disc is affixed to said shaft so as to rotate in correspondence with rotation of said shaft.

4. The pump of claim 1, wherein said disc set has a conical configuration.

5. The pump of claim 4, wherein the driven disc of said disc set bears against the inner wall of said bowl.

6. The pump of claim 5, wherein the driven disc is connected to the drive disc by a post such that the driven disc rotates in correspondence with a rotation of said drive disc.

7. The pump of claim 6, wherein the drive disc has the plurality of vanes extending toward the driven disc.

8. The pump of claim 7, wherein the driven disc has the plurality of vanes extending toward said drive disc.

9. The pump of claim 1, wherein each of the plurality of micro-vanes has an arcuate shape.

10. The pump of claim 1, wherein the drive disc is disposed coaxially with respect to the driven disc.

11. The pump of claim 1, wherein the driven disc has a hole at a center thereof, the hole being disposed so as to face the inlet of said bowl.

12. The pump of claim 1, further comprising:

a first plurality of vanes affixed to an exterior surface of said lodging and extending in a direction toward the inner wall of said bowl; and a second plurality of vanes affixed to the inner wall of said bowl and extending toward the exterior of said lodging, the first and second pluralities of vanes defining a space therebetween through which the multiphase fluid flows.

13. The pump of claim 1, wherein the outlet of said bowl extends from said lodging to an end of said bowl, the outlet widening in diameter from the lodging toward the end of said bowl.

14. The pump of claim 1, further comprising:

a helical-axial impeller positioned adjacent the inlet of said bowl, said helical-axial impeller adapted to maintain a pressure of the multi-phase fluid.

* * * * *